US008286718B2

(12) United States Patent
Braddick

(10) Patent No.: US 8,286,718 B2
(45) Date of Patent: Oct. 16, 2012

(54) DOWNHOLE TUBULAR EXPANDER AND METHOD

(75) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 442 days.

(21) Appl. No.: 12/696,684

(22) Filed: Jan. 29, 2010

(65) Prior Publication Data

US 2011/0186288 A1 Aug. 4, 2011

(51) Int. Cl.
*E21B 23/00* (2006.01)

(52) U.S. Cl. ..... 166/382; 166/208

(58) Field of Classification Search ..... 166/382, 166/384, 206, 208, 243
See application file for complete search history.

(56) References Cited

U.S. PATENT DOCUMENTS

| | | | | |
|---|---|---|---|---|
| 3,948,321 | A | 4/1976 | Owen et al. | |
| 6,705,395 | B2 | 3/2004 | Cook et al. | |
| 7,093,656 | B2 * | 8/2006 | Maguire | 166/277 |
| 7,114,559 | B2 * | 10/2006 | Sonnier et al. | 166/206 |
| 7,225,880 | B2 | 6/2007 | Braddick | |
| 7,278,492 | B2 | 10/2007 | Braddick | |
| 7,493,946 | B2 * | 2/2009 | Filippov et al. | 166/216 |
| 8,100,188 | B2 * | 1/2012 | Watson | 166/382 |
| 2001/0020532 | A1 | 9/2001 | Baugh et al. | |
| 2010/0038096 | A1 * | 2/2010 | Reimert et al. | 166/382 |
| 2010/0252278 | A1 * | 10/2010 | Harris et al. | 166/382 |

* cited by examiner

*Primary Examiner* — Daniel P Stephenson
(74) *Attorney, Agent, or Firm* — Streets & Steele

(57) ABSTRACT

A liner hanger (10) is provided for supporting a liner in a well. An expandable tubular hanger (90) is positioned within the well and a running tool with a tool mandrel (34) passes fluid through the running tool. An actuator (12) forcibly moves the tubular expander to an expanded position. Release of the running tool from the liner may be accomplished with a retainer (84) and downward movement of the mandrel, with fluid pressure acting on a hydraulic piston (28) coupled with rotation of the mandrel, or by safety joint (68) along the tubular mandrel.

20 Claims, 3 Drawing Sheets

DOWNHOLE TUBULAR EXPANDER AND METHOD

FIELD OF THE INVENTION

The present invention relates tools and techniques to radially expand a downhole tubular in a well. More particularly, this invention relates to a liner hanger expander with improved tool release features.

BACKGROUND OF THE INVENTION

Various types of liner hanger have been proposed for hanging a liner from a casing string in a well. Many liner hangers are set with slips activated by the liner hanger running tool. Liner hangers with multiple parts pose a significant liability when one or more of the parts become loose in the well, thereby disrupting the setting operation and making retrieval difficult. Other liner hangers and running tools cannot perform conventional cementing operations through the running tool before setting the liner hanger in the well.

Conventional liner hangers have problems supporting heavy liners with the weight of one million pounds or more. Some liner hangers successfully support the liner weight, but do not reliably seal with the casing string. Other liner hangers are not able to obtain burst and/or collapse characteristics equal to that of the casing. A preferred liner hanger maintains a collapse and burst strength at least substantially equal to that of both the casing and the liner.

Another significant problem with some liner hangers is that the running tool cannot be reliably disengaged from the set liner hanger for retrieval to the surface. This problem with liner hangers becomes more involved with the desirability to rotate the liner with the work string in the well, e.g., for a liner drilling operation, wherein the operator desires to disengage the work string and tool when the liner hanger has been set, thereby allowing the running tool and the work string to be retrieved from the well.

Publication 2001/0020532A1 discloses a tool for hanging a liner by pipe expansion. U.S. Pat. No. 3,948,321 discloses a reinforcing swage which remains downhole when the tool is retrieved to the surface. U.S. Pat. No. 6,705,395 discloses a radially expanded liner hanger which uses an axially movable annular piston to expand a tubular member. U.S. Pat. Nos. 7,225,880 and 7,278,492 disclose an expandable liner hanger system and method.

The disadvantages of the prior art are overcome by the present invention, and an improved liner hanger system and method of releasing the liner hanger are hereinafter disclosed.

SUMMARY OF THE INVENTION

An expandable liner hanger system and method achieves positioning, suspension, sealing and optional cementing of a liner in a subterranean well. In an exemplary application, the method involves expansion of a high strength steel tubular hanger body having slips and packing elements positioned about its outer circumference for contact with the inner surface of a casing string, which has a larger internal diameter than the initial external diameter of the liner and liner hanger when run in the well through the casing string.

The present invention preferably uses a tubular expander to expand the hanger body, and the tubular expander remains inside the expanded hanger body for support at its final expanded diameter, thus sandwiching the expanded plastically deformed hanger body between the outer casing and the tubular expander. This method provides improved sealing and gripping capability, and requires shorter lengths of expandable tubular liner hanger, typically in the range of from one to five feet.

In the preferred embodiment, three different mechanisms for release of the tool from the liner hanger may be used. In the first technique, a retainer is secured to the tool mandrel, and the downward movement of the work string and thus the mandrel and the retainer releases collet fingers connecting the tool mandrel to the tubular hanger, thereby releasing the tool so that it may be retrieved to the surface. The tool is also provided with hydraulic piston supported on the mandrel to selectively engage and disengage a clutch rotatably connecting the tool mandrel and a housing supporting latching members. When the clutch is engaged, rotation of the work string rotates the mandrel and a bit at the lower end of the liner. The latching members rotatably connect the tubular hanger and a supporting housing, such that when the clutch is disengaged, rotation of the mandrel arm will unthread the retainer which is rotatably connected to the tubular hanger, thereby providing a separate release mechanism to retrieve the tool to the surface. A safety joint is threadably connected to the tool mandrel and an upper collet retainer, such that left-hand rotation of the mandrel releases an upper portion of the mandrel from the clutch, thereby providing a third release mechanism.

These and further features and advantages of the present invention will become apparent from the following detailed description, wherein reference is made to the figures in the accompanying drawings.

DETAILED DESCRIPTION OF PREFERRED EMBODIMENTS

A liner may be conveyed into the well to the desired setting or suspension depth by a drill pipe or work string connected to a multi-stage, double action hydraulic setting and releasing tool (running tool) that furnishes the necessary forces to expand the liner hanger assembly into engagement with the casing. The running tool may be constructed of sufficiently high strength steel to support the weight of the liner as it is run into the well and to provide the necessary force to expand the liner hanger assembly. Additionally, the running tool preferably has a sufficiently large internal bore in its central mandrel to enable passage and displacement of cement for cementing the liner within the well bore.

Figure 1:
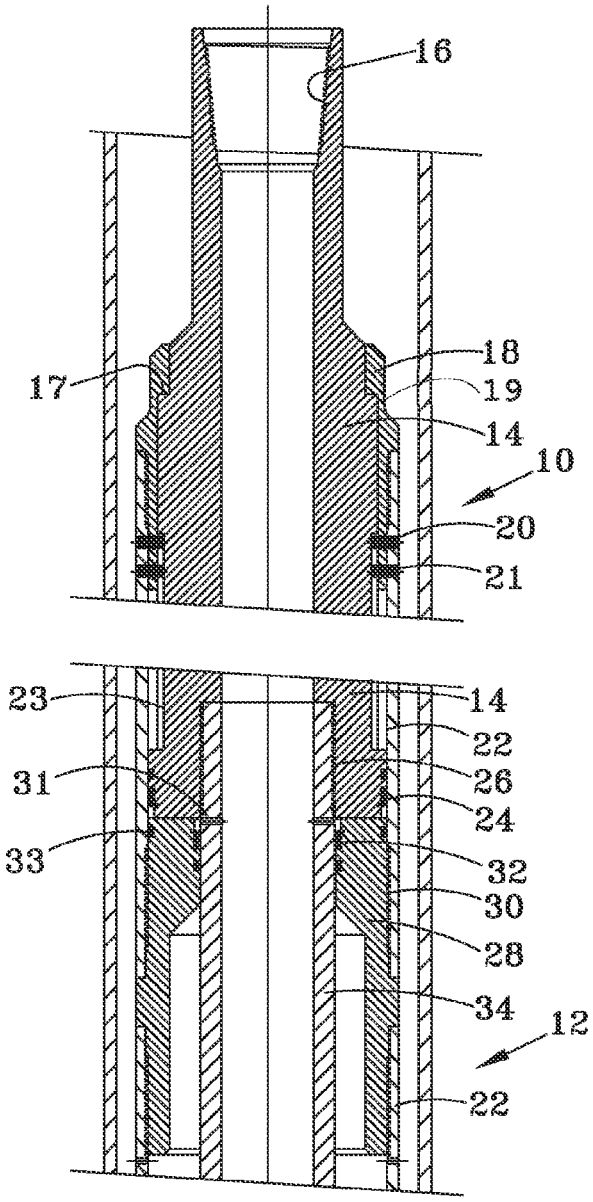
FIG. 1 illustrates in cross-section an upper portion of the tool positioned within a casing.
Figure 2:
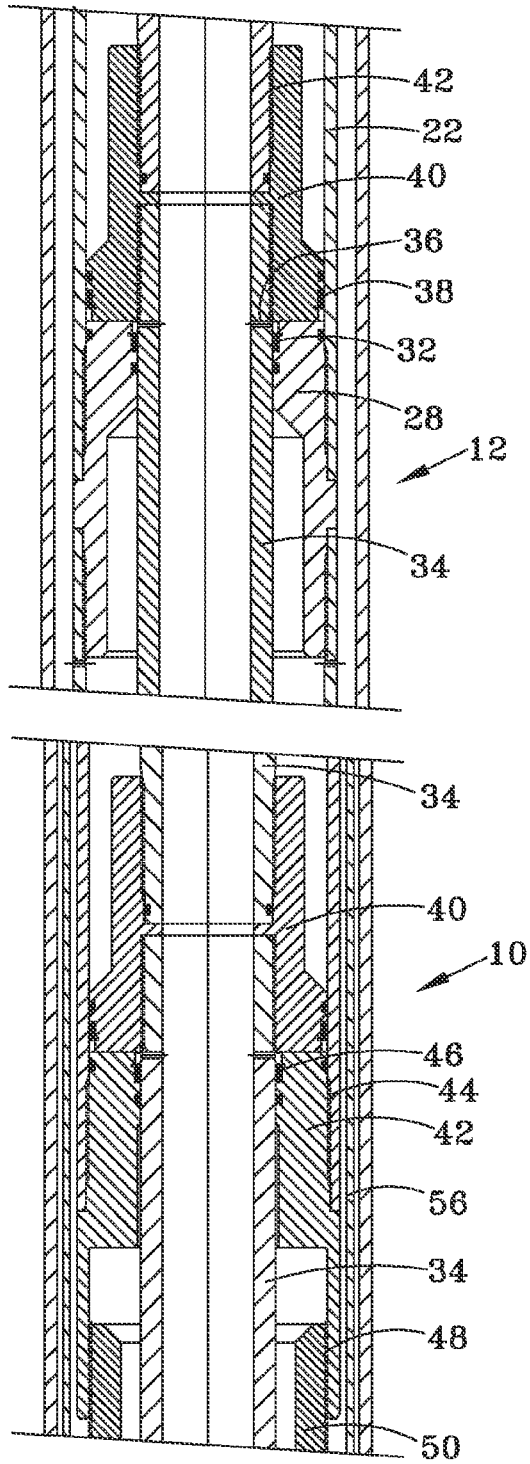
FIG. 2 illustrates a lower portion of the tool, including portions of a hydraulic actuator.

Referring to FIG. 1, the upper end of the running tool 10 may include a hydraulic actuator assembly 12, which is shown in greater detail in FIG. 2. A top connector 14 is structurally connected by threads 16 to a work string (not shown), and to the running tool inner mandrel 34. One or more seals 24 provide dynamic sealing of connector 14 and outer sleeve 22, and threads 26 connect 14 and mandrel 34. A throughport 31 in the mandrel 34 allows fluid pressure within the interior of the running tool to act on the outer piston 28, which as shown includes conventional seals 33 for static sealing with the outer sleeve 22 and seals 32 for dynamic sealing with the mandrel 34. Threads 30 structurally connect the outer piston 28 to outer sleeve 22. A predetermined amount of fluid pressure within the running tool acting on the outer piston 28 will thus provide downward movement of the outer sleeve 22.

Shear ring 18 engages shoulder 17 on connector 14, and is threaded to outer sleeve 22 and rotatably pinned to outer sleeve 22 by one or more pins 20, 21. Shear ring 18 prevents activation of the tool until a predetermined amount of pressure is applied to generate force sufficient to break the reduced wall section 19 and thereby allow upward movement of connector 14 and mandrel 34 relative to the outer sleeve 22. Pins 20, 21 slide within slots 23 to provide non-rotational interconnection between the outer sleeve 22 and the mandrel 34.

Referring now to FIG. 2, an inner piston 40 is threadably connected to the mandrel 34 by threads 42. Ports 36 in the mandrel allow for passage of fluid between the inner piston 40 and a lower outer piston 28. The inner piston 40 includes one or more static seals for sealing engagement with the mandrel, and includes one or more dynamic seals 38 for dynamic sealing engagement with the outer sleeve 22. Outer piston 28 in turn includes static seals for sealing with the outer sleeve 22, and dynamic seals 32 for sealing engagement with the mandrel 34. Ports similar to 36 may be provided at various locations in the mandrel to provide for the reliable actuation of the inner and outer pistons. FIG. 2 also depicts another lower inner piston 40 threaded to the mandrel 34 and also containing static seals for sealing with the mandrel, and dynamic seals for sealing with the outer sleeve 22. A lower sealing block 42 is threadably connected by threads 44 to outer sleeve 22, and similarly contains outer static seals for sealing with outer sleeve 22 and inner dynamic seals for sealing engagement with the mandrel 34.

Figure 3:
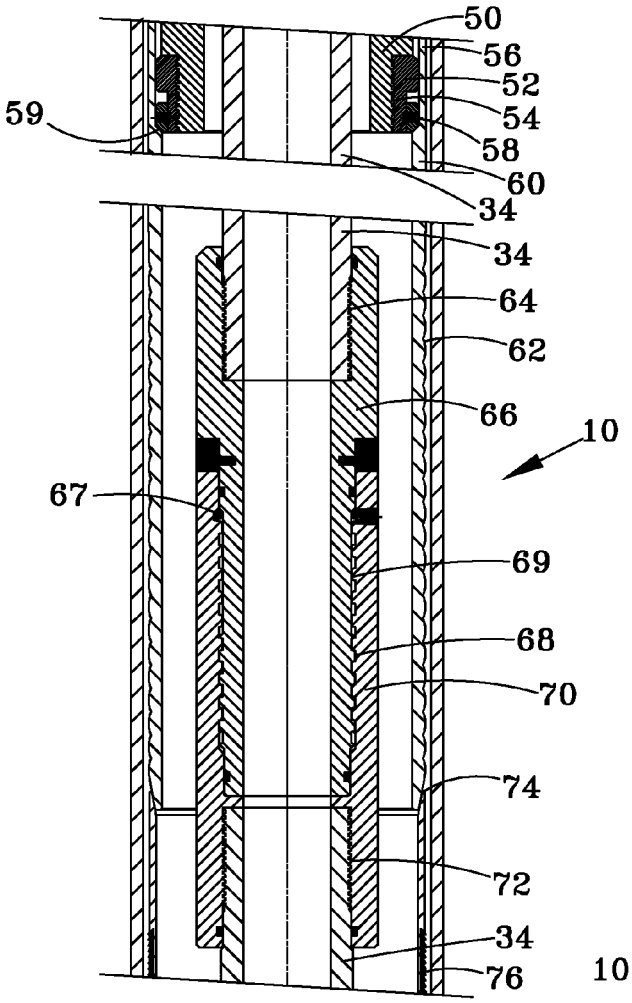
FIG. 3 illustrates an intermediate portion of the tool, and specifically shows the safety release joint.

The lower end of the sealing block 42 includes threads 48 for threaded engagement with sleeve 50, which as shown in FIG. 3, contains a retainer 52 threaded at 54 to sleeve 50, and including one or more shear pins and shear sleeve 58 for engaging the shoulder 59 on tubular expander 60. FIG. 2 depicts the upper end 56 of the expander body show more clearly in FIG. 3. Expander 60 preferably includes a plurality of annular radially outer bumps 62 and a lower tapered portion 74 for increasing the diameter of the tubular hanger when moved downward relative to the liner hanger. The lower end of the mandrel 34 is threaded at 64 to upper connector 66, which is threaded at 68 to lower connector 70. Threads 72 secure the lower connector to the lower portion of the mandrel 34.

Figure 4:
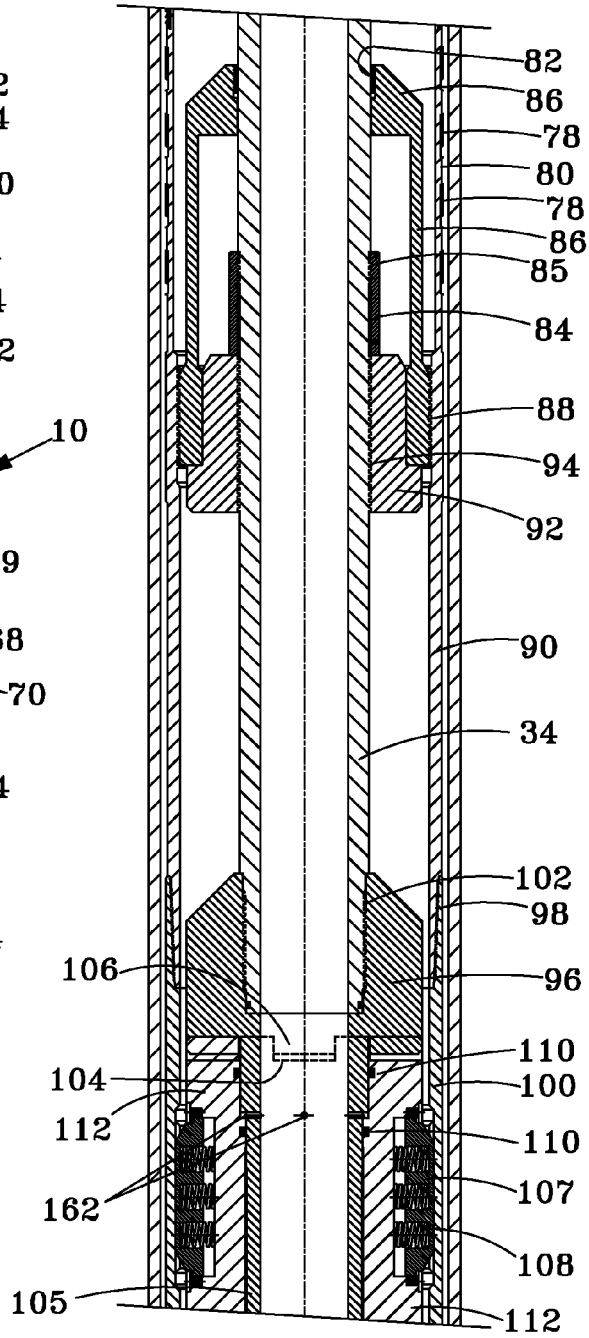
FIG. 4 illustrates a lower portion of the tool with a collet mechanism and dogs rotatably engaging the tool and the liner.

As shown in FIGS. 3 and 4, the tubing hanger 90 includes an upper hanger body 80 with a plurality of vertically spaced slips 76 and packing or other sealing elements 78. Collet mechanism 86 includes lower collets which are threaded at 88 to the body of the tubing hanger 90. Nut 92 is threaded at 94 to the mandrel 34. Upward movement of the nut relative to the mandrel is prevented by sleeve retainer 84 which is threaded at 85 to the mandrel 34.

The lower end of the mandrel 34 in FIG. 4 is threaded at 102 to the upper clutch body 96, which includes a downwardly extending member 106 which fits within a suitable receptacle 104 provided in the lower clutch body 112. Circumferentially spaced dogs or similar blocks 107 are outwardly biased by respective springs 108 for engaging an axial spline in the liner body 100, thereby rotatably interconnecting the block 112 and the liner. Conventional static seals 110 are also provided. The dogs 107 rotatably connect the liner to the block 112 thereby allowing rotation at the liner and a bit at the lower end of the liner when the mandrel 34 and the clutch formed by engagement of 104 and 106. Ports 162 in mandrel extension 105 allow pressure to act on the smaller diameter seal to force block 112 downward, thereby disengaging the clutch. Mandrel 105 as shown in FIG. 5 thus rotates within the block 112.

Figure 5:
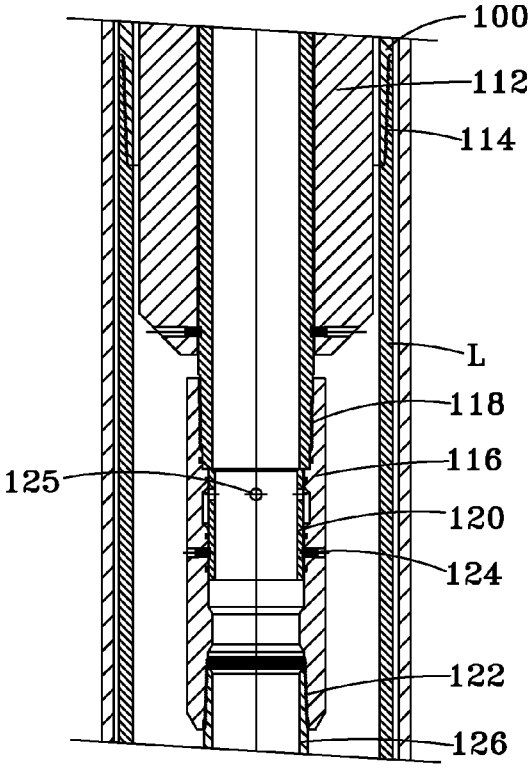
FIG. 5 illustrates a lower portion of the tool with a ball seat.

FIG. 5 shows the lower end of the liner connected to the liner body 100 connected to the liner L by threads 114. Ball seat 120 is also shown in FIG. 5, and is initially retained in an upper position with respect to sleeve 116 by a plurality of pins 124. The sleeve 120 moves downward relative to sleeve 116 and when pins 124 shear, thereby opening ports 125 to fluid internal of the mandrel. The lower end of the sleeve 116 is threaded at 122 to lower mandrel extension 126.

Figure 6:
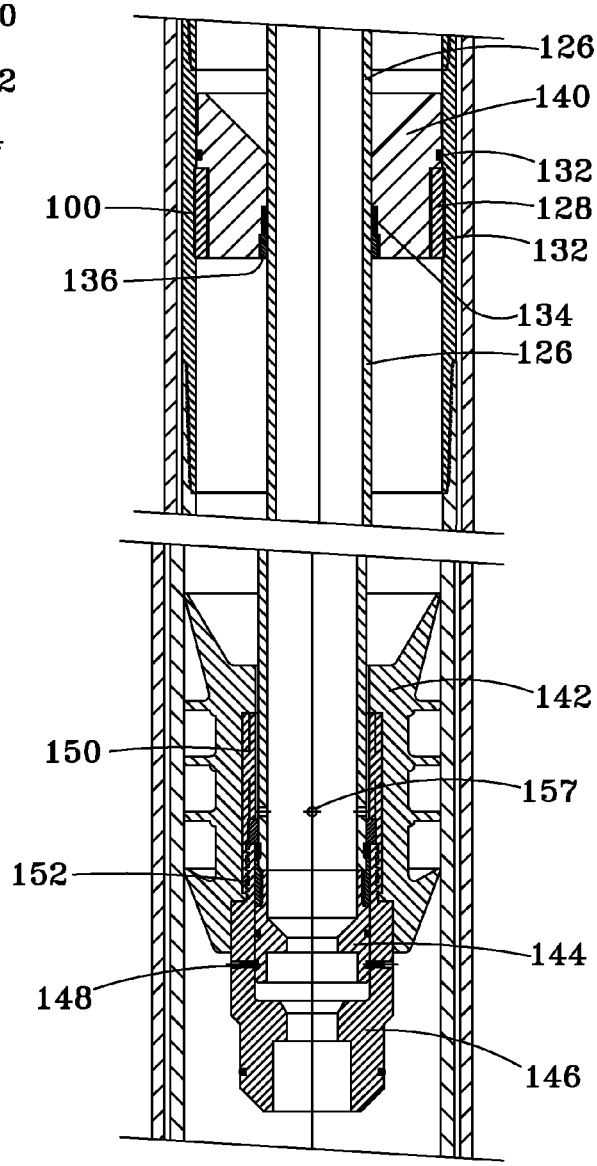
FIG. 6 illustrates a cementing plug on a still lower portion of the tool.

Referring now to FIG. 6, mandrel sleeve 126 passes through guide block 140, which includes seal 134 and retainer 136 for sealing with sleeve 126, and seal 132 and guide ring 128 for sealing with liner body 100. Cementing plug 142 is also shown in FIG. 6, including inner sleeve 150 and port 157. Ball seat 144 is pinned at 148 to lower wiper body 146, which is threaded at 152 to sleeve 150.

The liner may be run to setting depth on drill pipe and cemented in a conventional manner. The cement may be displaced from the drill pipe and liner and into the well bore/liner annulus using cement wiper plugs as is customary in the art. Once the plugs have displaced the cement and seated near the bottom of the liner, pressure may be applied to fluid within the work string and consequently through the pressure ports of the mandrel and into the pressure chambers formed between upward moving pistons and downward moving pistons. Pressure may be increased until the force created is sufficient to cause the expander to move downward, forcing the expander into the upward facing receptacle of the liner hanger body. Forcing the expander downward causes the liner hanger body to expand radially outward, forcing slips and sealing elements into engagement with the inside surface of the casing, thus sealing and supporting the liner hanger within the casing.

If pressure within the drill pipe and liner cannot be increased after landing the wiper plugs, a setting ball may be dropped into the drill pipe and permitted to gravitate until the ball engages the seat at the lower end of the running tool. Pressure may then be increased to operate the setting tool.

As disclosed herein, the tubular expander is positioned at least partially within the hanger body, thereby radially expanding at least part of the liner hanger body. In other cases, all or substantially all of the tubular expander will be within the liner hanger body when the assembly is set. Complete insertion of the tubular expander within the liner hanger body is not required, however, for all applications.

One technique for releasing the tool from the liner involves axial movement of the work string, i.e., use of the set down weight to release the tool from the liner. This technique allows the work string and thus the retainer or nut 92 threaded to the mandrel to move downward, while the collet mechanism 86 remains engaged with the tubing hanger 90. This downward movement thus allows the collet fingers to be released in the retainer 92, so the entire tool may be retrieved to the surface by subsequently pulling the work string. While this operation is relatively simple and reliable, it does require that the work string be moveable downward relative to the liner, which may not be possible if the hydraulic pistons have stroked the expander 60 to a downward position to expand the hanger body 80.

Another technique for releasing the tool from the liner involves the use of hydraulic fluid to pass through the ports 162 as shown in FIG. 4, thereby pressurizing the lower clutch body 112, which acts as a piston. This action disengages the downward extending member 106 from the receptacle 104, which allows the work string and thus the mandrel 34 to be rotated while the dogs 107 maintain the tubing hanger 90 stationary. This rotation will thus lower the retainer 92 with respect to the mandrel, and continued rotation of the work string effectively disengages the retainer or nut 92 from the collet mechanism 86, thereby allowing the collets to collapse so that tool may be retrieved to the surface. While this operation is also reliable, it does require that fluid pressure be applied to disengage the clutch, and there may be applications wherein sufficient fluid pressure cannot be obtained downhole to accomplish the release of the tool by this mechanism.

Yet another mechanism for releasing the tool to be retrieved to surface involves rotation of the work string and thus the mandrel 34, such that the thread 68 begins to unthread, hereby moving a lower portion of the mandrel 34 downward, and thus moving the retainer 92 downward and disengaging the retainer from the collet mechanism 86. The thread 68 as shown in FIG. 3 may be used with one or more ball members 67 to ride within unfilled thread cavities 69 in the lower connector 70. Once the threads 68 on the exterior of the upper connector 66 engage the ball members 67, no further unthreading of the connection occurs, so that the upper connector 66 remains engaged with the lower connector 70, although the lower connector 70 and the mandrel 34 beneath the upper connector 66 have moved downward axially relative to the upper connector.

According to the present invention, one technique for releasing the tool from the liner involves axial movement (set down) of the work string, while another technique involves a combination of hydraulic fluid pressure and rotation of the work string, while the third technique involves left-hand rotation of the work stream.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A liner hanger for supporting a liner in a well, comprising:

an expandable tubular hanger having initial run-in diameter and an expanded diameter for supporting the liner in the well;

a running tool supported on a work string and having an internal bore within a tool mandrel for passing fluid through the running tool;

a tubular expander supported on the running tool, the tubular expander having an expander outermost diameter greater than the initial run-in diameter of the tubular hanger;

an actuator for forcibly moving the tubular expander axially from a position substantially axially spaced from the tubular hanger to a position substantially within the tubular hanger, thereby radially expanding the tubular hanger;

a retainer secured to the tool mandrel, such that downward movement of the work string and the retainer releases collet fingers connecting the tool mandrel to the tubular hanger, thereby releasing the collet fingers from the tubular hanger so that the tool may be retrieved to the surface by a first release mechanism;

a hydraulic piston responsive to fluid pressure within the mandrel to selectively engage and disengage a clutch rotatably interconnecting the tool mandrel and a housing supporting latching members, the latching members rotatably interconnecting the tubular hanger and the housing, such that when the clutch is disengaged, rotation of the mandrel will unthread the retainer from the tubular hanger, thereby providing a second release mechanism to retrieve the tool to the surface; and a safety joint threadably connecting the tool mandrel and the upper collet retainer, such that left-hand rotation of the mandrel axially lowers the retainer relative to the collet fingers, thereby providing a third release mechanism to retrieve a substantial portion of the tool to the surface.

2. A liner hanger as defined in claim 1, wherein rotation of a work string and the mandrel to the right rotates the liner to the right when the clutch is engaged, and rotation of the mandrel to the right unthreads the retainer when the clutch is disengaged.

3. A liner hanger as defined in claim 1, wherein the tubular expander remains downhole with the expanded tubular hanger to support the liner in the well.

4. A liner hanger as defined in claim 1, wherein the actuator comprises a plurality of axially stacked pistons powered by fluid pressure within the mandrel.

5. A liner hanger as defined in claim 1, wherein the safety joint is provided above the retainer.

6. A liner hanger as defined in claim 1, wherein the clutch is provided below the retainer.

7. A liner hanger as defined in claim 1, wherein the latching members are outwardly biased.

8. A liner hanger as defined in claim 1, wherein the liner supports a bit at a lower end thereof.

9. A liner hanger for supporting a liner in a well, comprising:

an expandable tubular hanger having initial run-in diameter and an expanded diameter for supporting the liner in the well;

a running tool supported on a work string and having an internal bore within a tool mandrel for passing fluid through the running tool;

a tubular expander supported on the running tool, the tubular expander having an expander outermost diameter greater than the initial run-in diameter of the tubular hanger;

an actuator for forcibly moving the tubular expander axially from a position substantially axially spaced from the tubular hanger to a position substantially within the tubular hanger, thereby radially expanding the tubular hanger;

a retainer secured to the tool mandrel, such that downward movement of the work string and the retainer releases the tool mandrel from the tubular hanger so that the tool may be retrieved to the surface by a first release mechanism;

a hydraulic piston responsive to fluid pressure within the mandrel to selectively engage and disengage a clutch rotatably interconnecting the tool mandrel and a housing supporting latching members, the latching members rotatably interconnecting the tubular hanger and the housing, such that when the clutch is disengaged, rotation of the mandrel will unthread the mandrel from the tubular hanger, thereby providing a second release mechanism to retrieve the tool to the surface; and a safety joint threadably connecting the tool mandrel and the tubular hanger, such that left-hand rotation of the mandrel axially lowers the retainer relative to the collet fingers, thereby providing a third release mechanism to retrieve the tool to the surface.

10. A liner hanger as defined in claim 9, wherein rotation of the work string and the mandrel to the right rotates the liner to the right when the clutch is engaged, and rotation of the mandrel to the right unthreads the retainer when the clutch is disengaged.

11. A liner hanger as defined in claim 9, wherein the liner supports a bit at a lower end thereof.

12. A liner hanger as defined in claim 9, wherein the latching members are outwardly biased.

13. A liner hanger as defined in claim 9, wherein the tubular expander remains downhole with the expanded tubular hanger to support the liner in the well.

14. A liner hanger as defined in claim 9, wherein the actuator comprises a plurality of axially stacked pistons powered by fluid pressure within the mandrel.

15. A liner hanger for supporting a liner in a well, comprising:

an expandable tubular hanger having initial run-in diameter and an expanded diameter for supporting the liner in the well;

a running tool supported on a work string and having an internal bore within a tool mandrel for passing fluid through the running tool;

a tubular expander supported on the running tool, the tubular expander having an expander outermost diameter greater than the initial run-in diameter of the tubular hanger, the tubular hanger remaining downhole with the expanded tubular hanger to support the liner in the well;

an actuator including a plurality of axially stacked pistons for forcibly moving the tubular expander axially from a position substantially axially spaced from the tubular hanger to a position substantially within the tubular hanger, thereby radially expanding the tubular hanger;

a retainer secured to the tool mandrel, such that downward movement of the work string and the retainer releases collet fingers connecting the tool mandrel to the tubular hanger, thereby releasing the collet fingers from the tubular hanger so that the tool may be retrieved to the surface by a first release mechanism;

a hydraulic piston responsive to fluid pressure within the mandrel to selectively engage and disengage a clutch rotatably interconnecting the tool mandrel and a housing supporting latching members, the latching members rotatably interconnecting the tubular hanger and the housing, such that when the clutch is disengaged, rotation of the mandrel will unthread the retainer from the tubular hanger, thereby providing a second release mechanism to retrieve the tool to the surface; and a safety joint threadably connecting the tool mandrel and the upper collet retainer, such that left-hand rotation of the mandrel axially moves the retainer relative to the collet fingers, thereby providing a third release mechanism to retrieve the tool to the surface.

16. A liner hanger as defined in claim 15, wherein rotation of the work string and the mandrel to the right rotates the liner to the right when the clutch is engaged, and rotates the mandrel to the right and unthreads the retainer when the clutch is disengaged.

17. A liner hanger as defined in claim 16, wherein the liner supports a bit at the lower end thereof.

18. A liner hanger as defined in claim 15, wherein the third release mechanism is provided above the first release mechanism.

19. A liner hanger as defined in claim 15, wherein the clutch is provided below the first release mechanism.

20. A liner hanger as defined in claim 15, wherein the latching members are outwardly biased.

* * * * *